US005887284A

United States Patent [19]

Simmons

[11] Patent Number: 5,887,284

[45] Date of Patent: Mar. 30, 1999

[54] REMOVABLE ANTERIOR SWEATBAND ASSEMBLY FOR A CAP OR HAT

[76] Inventor: John J. Simmons, 220 Avenue B West, Bismarck, N. Dak. 58501

[21] Appl. No.: 863,172

[22] Filed: May 27, 1997

[51] Int. Cl.[6] ..... A42C 5/02

[52] U.S. Cl. ..... 2/181.4; 2/181; 2/184; 2/195.5

[58] Field of Search ..... 2/181, 181.2, 181.4, 2/184, 175.4, 195.5, DIG. 11

[56] References Cited

U.S. PATENT DOCUMENTS

| | | | |
|---|---|---|---|
| 1,567,931 | 12/1925 | Epler . | |
| 2,263,395 | 11/1941 | Page | 2/181 |
| 2,403,676 | 7/1946 | Modlinski | 2/94 |
| 2,696,618 | 12/1954 | Hoffman et al. | 2/181 |
| 3,988,568 | 10/1976 | Mantell | 219/211 |
| 4,190,054 | 2/1980 | Brennan | 128/402 |
| 4,204,543 | 5/1980 | Henderson | 128/402 |
| 4,326,533 | 4/1982 | Henderson | 128/402 |
| 4,425,917 | 1/1984 | Kuznetz | 128/403 |
| 4,576,169 | 3/1986 | Williams | 128/402 |
| 5,072,598 | 12/1991 | Dibrell | 62/259.3 |
| 5,088,549 | 2/1992 | Schneider | 165/46 |
| 5,197,292 | 3/1993 | McPherson | 62/56 |
| 5,295,949 | 3/1994 | Hathaway | 602/18 |
| 5,305,470 | 4/1994 | McKay | 2/7 |
| 5,313,668 | 5/1994 | Bogan et al. | 2/181.4 |
| 5,605,144 | 2/1997 | Simmons | 126/204 |

FOREIGN PATENT DOCUMENTS

| | | | |
|---|---|---|---|
| 460200 | 9/1936 | United Kingdom . | |
| 466141 | 11/1936 | United Kingdom . | |
| 469769 | 2/1937 | United Kingdom . | |
| 500270 | 4/1937 | United Kingdom . | |
| 2130489 | 6/1984 | United Kingdom | A61F 7/10 |

OTHER PUBLICATIONS

1996 Product Folder (4 pgs.): "Personal Cooling and Heating Clothing" Thermo–Cool Products, Inc.; 3811 Lockport St.; Bismarck ND.

1996 Product Label: "Keeps You Cool When the Heat Is On" for Headband, Bandanna, Neck Wrap, Wrist Wrap—Thermo–Cool Products, Inc. 3811 Lockport St.; Bismarck, ND.

*Primary Examiner*—Diana L. Biefeld
*Attorney, Agent, or Firm*—James V. Harmon

[57] ABSTRACT

A removable anterior sweatband assembly suited for use in a baseball-style cap or hat that has a circular headband includes a perspiration-absorbent pad suspended from a support member between the cap headband and the forehead so as to prevent the forehead from contacting the headband of the cap. The pad includes an absorbent material for holding perspiration to help prevent the perspiration from the forehead of the person wearing the cap from contacting the cap. In one form, a four-layer structure or assembly is provided including a stiff supporting sheet and depending therefrom a laminate of three layers including the perspiration-absorbing layer, e.g., a super-absorbent cloth layer, a backing layer and a porous perspiration transferring layer between the absorbent layer and the forehead and in contact with the absorbent layer. The backing layer can be a porous absorbent material such as cloth or can be plastic film and can serve as a barrier for preventing the perspiration from staining the headband of the cap.

11 Claims, 4 Drawing Sheets

REMOVABLE ANTERIOR SWEATBAND ASSEMBLY FOR A CAP OR HAT

FIELD OF THE INVENTION

This invention relates to improvements in caps and hats, and more particularly to a removable sweatband assembly.

BACKGROUND OF THE INVENTION

Most caps are designed and manufactured with a sweatband sewn into them as an integral part of the cap. The sweatband is normally composed of absorbent cotton or a mixture of cotton and polyester material designed to absorb or wick away sweat from the wearer's head. However, with continued use, the sweatband becomes soiled and is difficult to launder or clean. Indeed, during profuse sweating, the normal sweatband becomes soaked with sweat and, because of the excess wetting, the main body of the cap itself becomes stained. Since caps are difficult to launder or clean, a sweat-stained cap is normally ruined and must be discarded.

It has also been long recognized that evaporation is not entirely effective as a method of cooling. While a wetted material such as a wet towel or cloth placed over the head provides immediate cooling due to the evaporation of the moisture within the towel or cloth, when the towel or cloth dries out, the cooling stops. Such cooling is therefore uncontrolled and is limited in time by the amount of water that can be provided. Moreover, a moisture-soaked towel or cloth makes a person feel wet which is, of course, uncomfortable and hence undesirable.

In view of these and other deficiencies of the prior art, it is one object of the present invention to find a way of enabling the sweatband of a cap or hat to be easily laundered, washed or cleaned.

It is another object of the invention to provide a sweatband that can be removed and will provide a larger sweat-holding capacity than the sweatband of an ordinary hat or cap.

It is a further object of the invention to provide a sweatband that will fit a wide variety of caps, can be easily removed and, if desired, can be transferred from one cap to another.

Yet another object of the invention is to provide a removable sweatband that can be manufactured and assembled at a lower cost.

Still another object of the invention is to allow the user to pre-wet the removable sweatband with cold water to provide a cooling effect without being uncomfortable for the user and without producing a wet feeling, causing discomfort.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a removable anterior sweatband assembly suited for use in a hat or baseball-style cap having a circular headband. The removable sweatband assembly includes a support member, e.g., a fastener or a sheet of material adapted to be connected to the cap and a soft, perspiration-absorbent sheet or pad suspended from the support member at the anterior of the cap between the cap headband and the forehead so as to prevent the forehead from contacting the headband of the cap. The pad includes an absorbent layer to hold perspiration, and preferably a transfer layer that contacts the forehead as well as a backing layer in contact with the opposite side of the absorbent layer. The backing layer can serve as a barrier to prevent the perspiration from contacting the cap. In one form of the invention, a four-layer structure or assembly is provided including the supporting sheet and depending therefrom a laminate of three layers including the perspiration-absorbing layer, the backing and the perspiration-transferring layer which allows perspiration to wick from the forehead of the user to the absorbent layer. The backing layer can be a porous absorbent material such as cloth and can function as a barrier for preventing the perspiration from staining the headband or the rest of the cap. If desired, the backing layer can be cloth or a nonporous material such as plastic film, e.g., polyethylene film, to entirely block the transfer of moisture to the headband of the cap. The upper edge of the pad is connected to the supporting sheet, e.g., by means of sewing or other suitable fasteners so that the pad is suspended on the inside of the headband, i.e., between the headband and the forehead of the user. The sweatband assembly of the invention can be easily removed from the cap for laundering or for placement in another cap but is held securely within the cap during use.

THE FIGURES

DETAILED DESCRIPTION OF THE INVENTION

Figure 1:
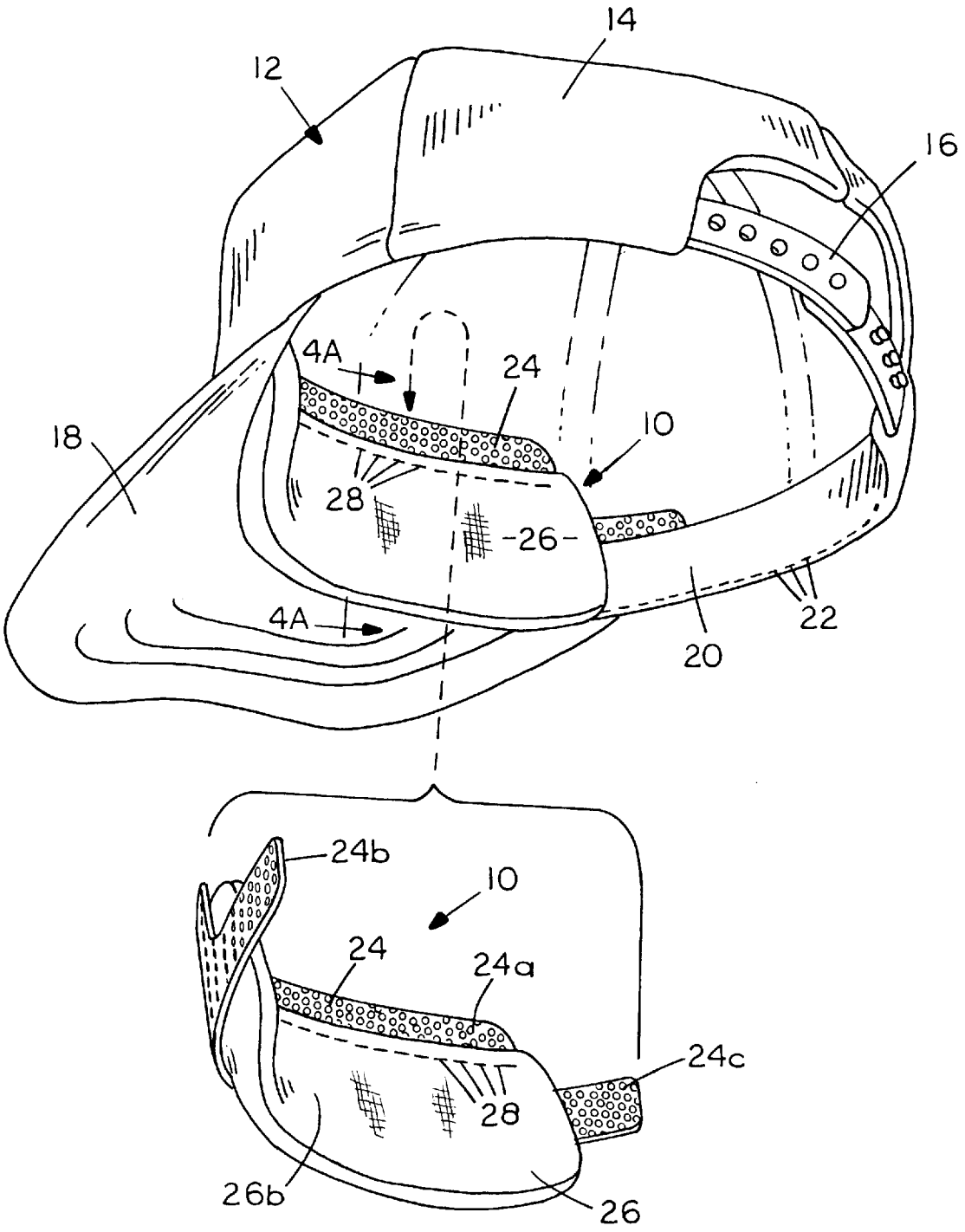
FIG. 1 is a perspective view showing the invention as it is being mounted in a baseball-style cap.
Figure 2:
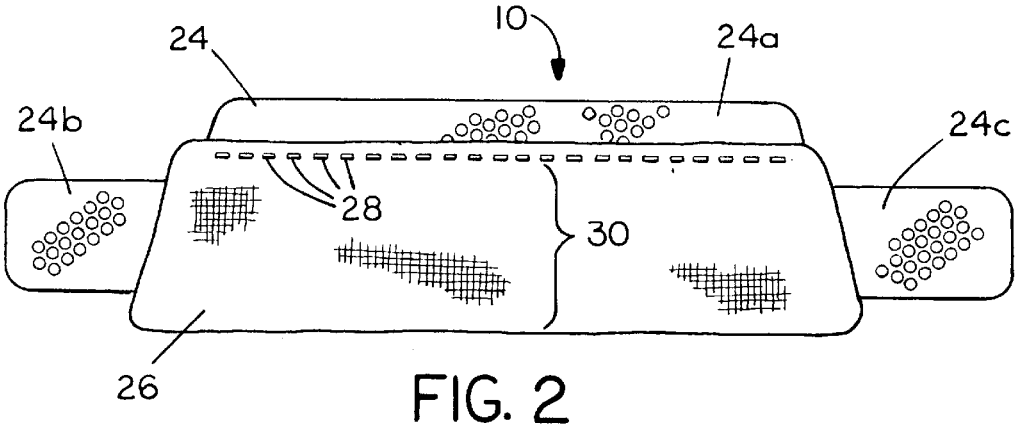
FIG. 2 is a plan view of the invention on a larger scale than in FIG. 1.
Figure 3:
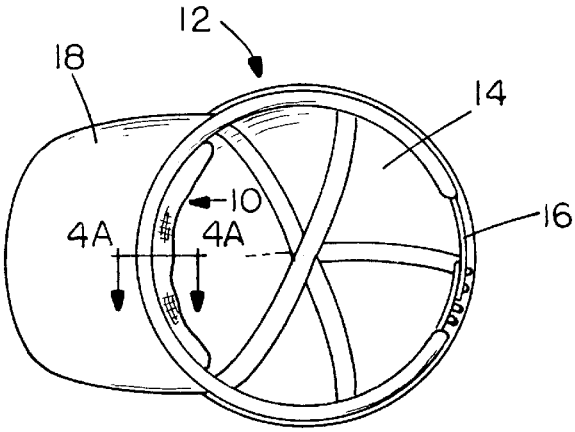
FIG. 3 is a bottom view of the cap of FIG. 1 on a reduced scale with the invention installed.

Refer now to FIG. 1 which illustrates a sweatband assembly of the invention indicated generally at 10 as it is being inserted into an ordinary, baseball-style cap 12. The cap 12 has the usual crown or upper portion 14 with a provision for size adjustment at 16, a bill 18, and a cloth headband 20 which is sewn to the upper portion 14 of the cap 12 around the entire rim of the cap by means of stitching 22. It should be understood that while the invention is described and is particularly effective in connection with baseball-style caps. It can also be used with other forms of hats, such as felt hats, straw hats, military-style hats, etc.

The removable sweatband assembly 10 of the invention serves as an insert which is placed in the cap 12 or hat. The sweatband assembly 10 includes a removable and washable perspiration-absorbent pad 26 at the anterior of the cap 12 to which water can be added, if desired, to provide a cooling effect to be discussed in more detail below. The pad 26 is held in place by a support or hanger member 24 which in this case has a generally vertically disposed, horizontally extending center portion **24*a* that terminates at either end in lateral extensions 24*b* and 24*c* of a reduced height. The center portion 24***a* extends above the headband 20. The moisture-absorbing pad or sheet 26, which can comprise one or more layers of material, is suspended from the support 24 by means of a horizontal row of stitches 28 or other suitable fasteners. While the support 24 has been shown as a sheet of material, it can have other forms. For example, the pad 26 can be supported by means of cooperating hook-and-loop fastener materials such as Velcro® or by snap fasteners, by adhesive, e.g., pressure-sensitive adhesive, or by means of pressure-sensitive tape bonded between the perspiration-absorbing pad 26 and the upper portion 14 of the cap 12. All of these possible forms and their equivalents will be referred to collectively hereinafter as a "support" for the moisture-absorbing pad 26.

The support 24 shown in the figures can be formed from any suitable lightweight sheet stock material that is stiff but capable of being flexed enough to conform to the contours of the head and particularly the forehead. It can be formed, for example, from a stiff, bendable, i.e., semi-flexible, material such as a sheet of polyethylene, from vinyl plastic, or even from a stiff sheet of coated paperboard. A sheet of 20 mil. polyethylene can be used, with or without ventilation openings as shown.

Figure 4A:
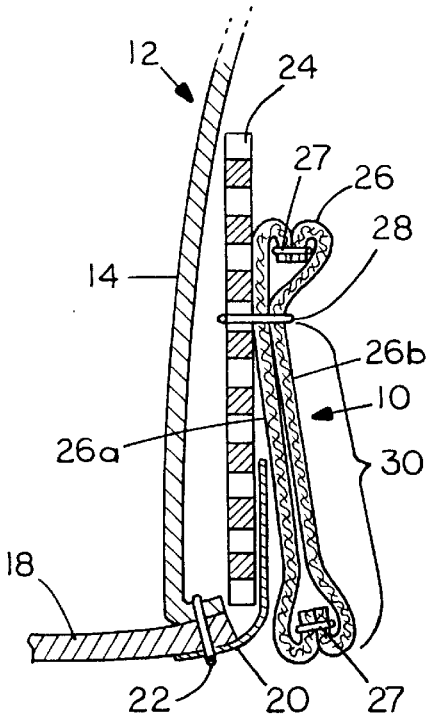
FIG. 4A is a horizontal cross-sectional view taken on line 4A—4A of FIG. 3 on a larger scale.

Refer now to FIG. 4A which describes the absorbent pad 26 in more detail. As shown in the figure, the pad 26 in this case comprises a laminate formed from two sheets of material, including a perspiration-absorbing layer 26*a* and a transfer layer 26*b* that contacts the forehead during use to facilitate the transfer of perspiration from the head of the user to the absorbent layer 26*a*. The two layers 26*a* and 26*b* are secured together by means of a sewn hem 27 that extends entirely around the laminate. The layers 26*a* and 26*b* can be of different materials or of the same material, e.g., poplin cotton cloth.

When the removable sweatband assembly 10 of the invention is to be used, it is placed within the front or anterior portion of the cap 12 so that the lower portion of the support 24 is positioned between the upper portion 14 of the cap and the cap headband 20 with the lateral extensions 24*b*, 24*c* on either side of the bill 18 and the center portion 24*a* aligned with the bill at the anterior of the cap 12 between the headband 20 and the upper portion 14 of the cap. The top of center portion 24*a* extends above the headband 20. The perspiration-absorbing pad 26 is held in this way by the support 24 so as to hang from the row of stitching 28 to thereby define a suspended or hanging portion 30 which lies inside the headband 20 as shown in FIG. 1 in contact with the forehead of the user.

The perspiration transfer layer 26*b* can be formed from any suitable, soft, porous material, e.g., cotton cloth that will conform to the contours of the head and will transfer the perspiration from the forehead to the absorbent layer 26*a*. It will also provide a soft, flexible inner surface to furnish added comfort for the user. When water is added to the pad 26, e.g., by holding the laminate under a cold water tap and then wringing it out briefly, the sweatband assembly 10 will provide a cooling effect for the user. However, even when no water is used, the sweatband assembly 10 will continue to protect the hat or cap 12 from being stained by perspiration by absorbing perspiration before it reaches the headband 20 of the cap 12.

Figure 4B:
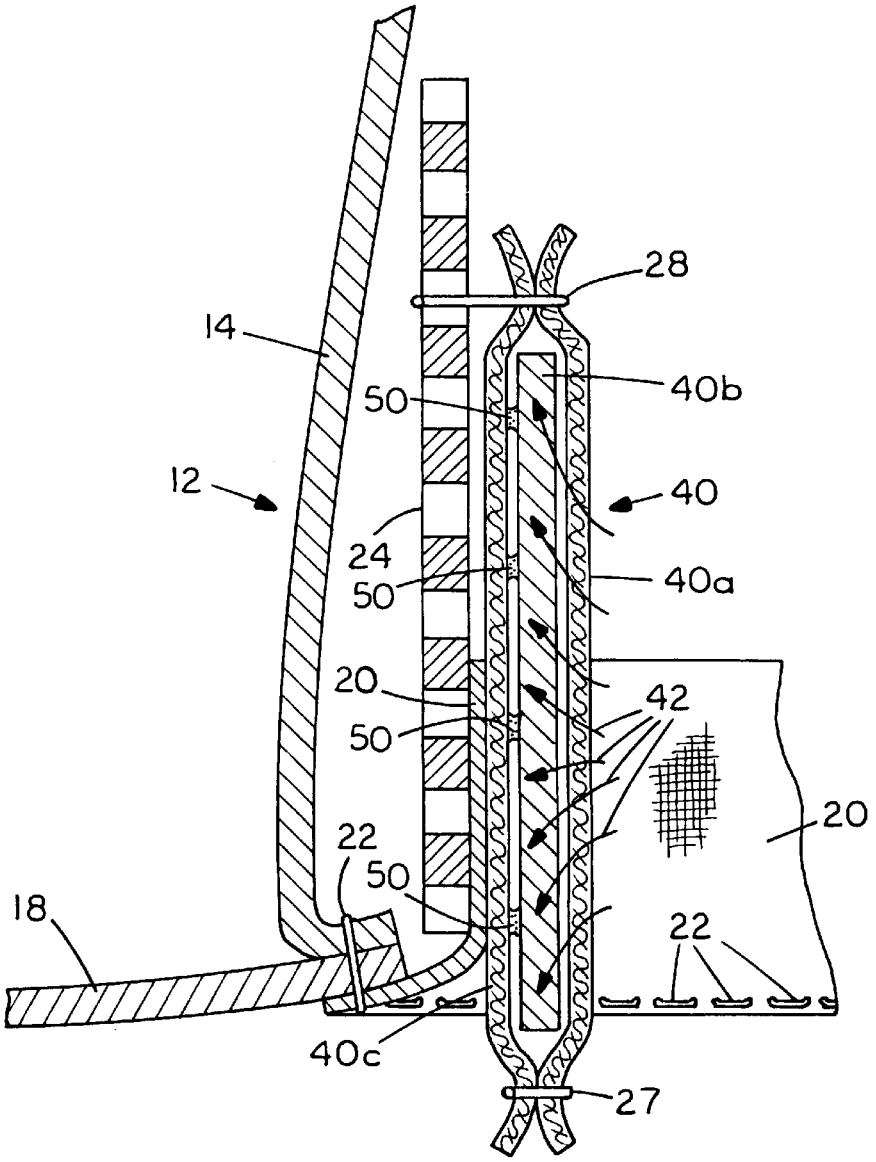
FIG. 4B is a view similar to FIG. 4A of another embodiment of the invention on a somewhat larger scale.
Figure 5:
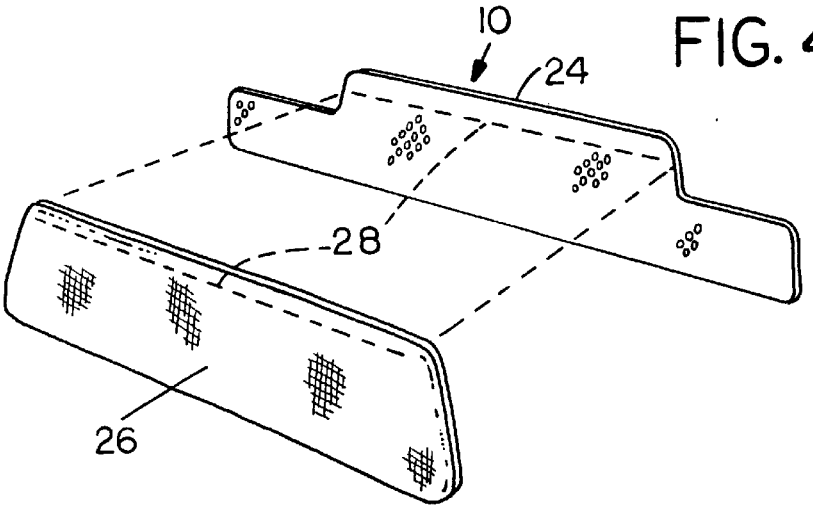
FIG. 5 is an exploded view of the invention.

Refer now to FIG. 4B which illustrates another form of the invention in which the same numerals refer to corresponding parts already described. In FIG. 4B is shown a flexible three-layer laminate 40 suspended in the same manner already described by the horizontal row of stitching 28 from the stiff but flexible support 24. The three-layer laminate 40 includes a flexible and porous perspiration-transfer layer 40*a* that contacts the forehead, a perspiration-absorbing layer 40*b* enclosed in the center of the laminate, and a backing layer 40*c* adjacent to the absorbing layer 40*b* and positioned between the absorbing layer and the support 24. The laminate 40 is fastened together by means of a sewn hem 27 extending around its entire periphery so that the absorbing layer 40*b* is sandwiched between the other layers and is thus enclosed on all sides. During use, the laminate 40 and its support 24 are placed in the anterior of the hat or cap 12 in the same manner already described with the portion of the laminate 40 below the stitches 28 suspended on the inside of a standard cap headband 20 so as to contact the forehead. Any perspiration on the user's forehead is absorbed by passing through the transfer layer 40*a* as shown by arrows 42 into the perspiration-absorbing layer 40*b*. Further transfer of perspiration is reduced or eliminated by the backing layer 40*c* which can be cloth or plastic film, if desired, to serve as a barrier for preventing the transfer of moisture from the absorbent layer 40*b* to the headband 20, thus eliminating any possibility of staining the headband 20. For general use, the layers 40*a* and 40*c* can be formed from cotton poplin fabric, and the layer 40*b* can be an absorbent cotton fabric or can comprise any suitable super-absorbent composite sandwiched between two layers of cloth, each woven from polyester and cotton. One example of a super-absorbent layer 40*b* is a super-absorbent nonwoven fabric sold under the trademark Gelok™ 4027 manufactured by Gelok Industries of Pine Lake Industrial Park, Dunbridge, Ohio. Alternatively, the absorbent layer 40*b* can comprise a layer of terrycloth, cotton batting, or cellulose sponge material to provide super-absorbent characteristic for soaking up the perspiration. A suitable poplin fabric that can be used for the transfer layer 40*a* and the backing layer 40*c* is a cloth made of cotton and polyester designated broadcloth and manufactured by the Troy Corporation, Chicago, Ill., or by Frank & Sons, Baltimore, Md.

The absorbent layer 40*b* can serve as an evaporative cooling sheet when moisture is added before use and can be held in place by quilting, e.g., by rows of stitches running in two different directions to provide a plurality of rows of stitches or by adhesive, e.g., hot-melt adhesive secured at points designated 50. Alternatively, the points 50 can be thermoplastically bonded points in which a thermal bond is formed by heating, e.g., with a laser to secure the absorbent sheet 40*b* in place, i e., to prevent the perspiration-absorbing layer 40*b* from moving within the laminate 40.

Figure 6:
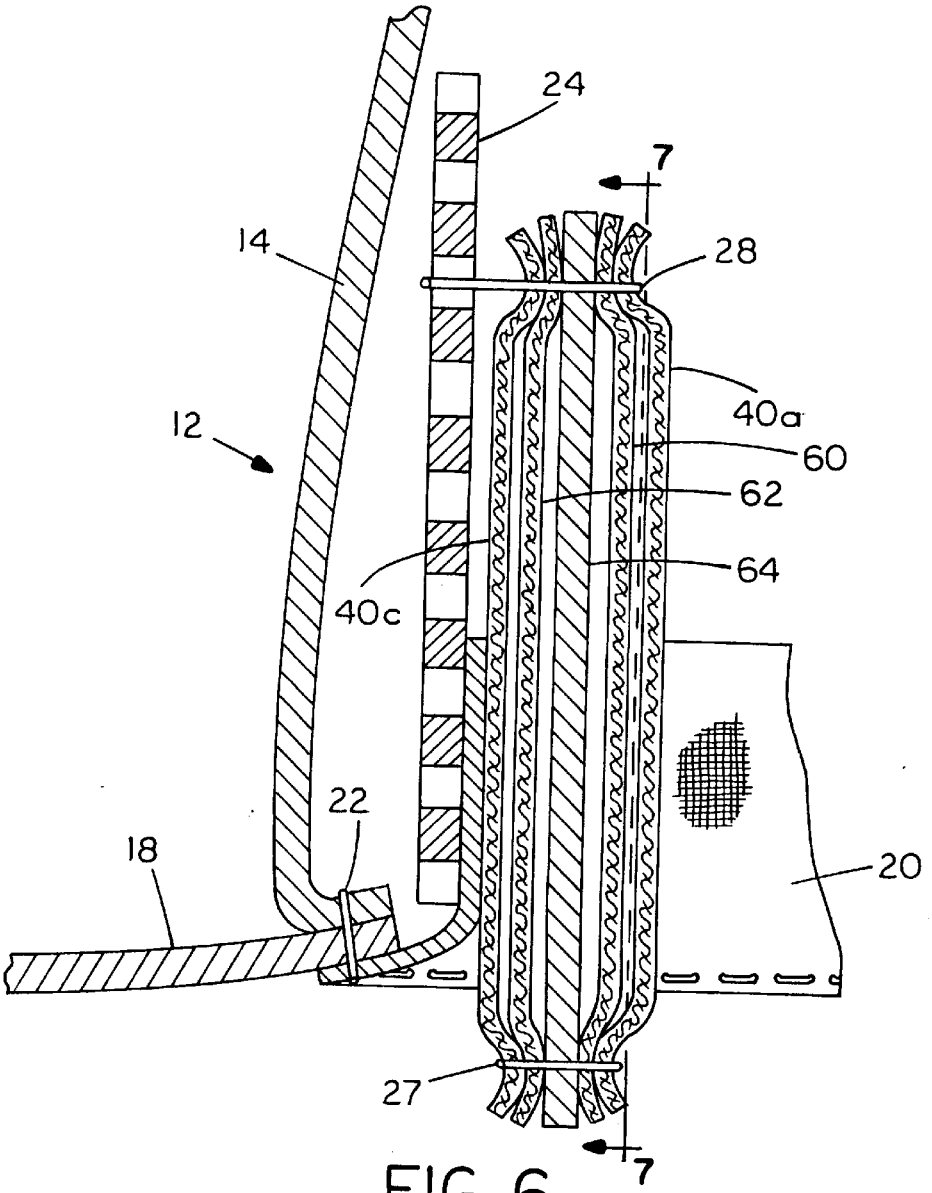
FIG. 6 is a vertical sectional view similar to FIG. 4B.
Figure 7:
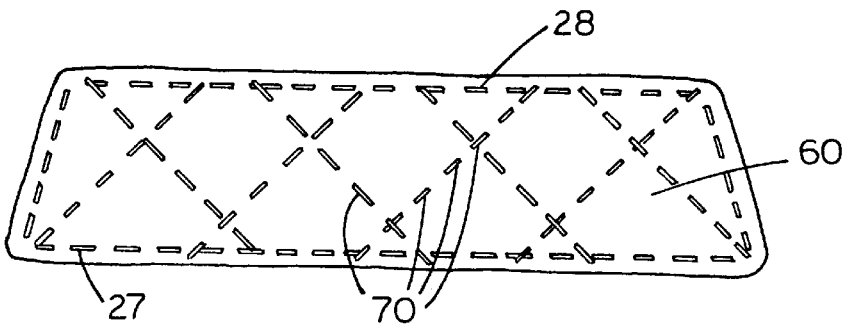
FIG. 7 is a vertical sectional view taken on line 7—7 of FIG. 6 to show the surface of the absorbent pad.

Refer now to FIGS. 6 and 7.

In FIGS. 6 and 7 is shown another embodiment of the invention in which the perspiration-absorbing material is itself a composite with an absorbent layer 64, which can be a layer of super-absorbent cloth, at the center sandwiched between a front layer of flexible porous sheet material, e.g., a cloth 60 formed from a combination of polyester and cotton, and a flexible backing layer 62 can be the same material. The super-absorbent layer 64 preferably comprises a super-absorbent nonwoven fabric that absorbs many times its own weight in water and can be obtained commercially from any of a variety of manufacturers. One super-absorbent nonwoven fabric that can be used is nonwoven super-absorbent cloth, e.g., Gelok™ which contains a hydrocolloid adapted to form a stable gel when saturated with moisture. Other sweat-absorbing fabrics can be used if desired in place of the cloth layer 64, e.g., terrycloth. The layers 40*a*, 40*c* and the composite 60, 62, 64 can be stitched together by means of stitches 27 and 28 that extend around the entire periphery of the composite (FIG. 7). The front layer 40*a* and the back layer 40*c* form a protective covering around the absorbent composite 60, 62, 64 to prevent a gel formed when the absorbent layer 64 is wetted by perspiration or water from leaking through the stitched seams and fabric of layers 40*a* and 40*c*. In this way the composite 60, 62, 64 is attached around its edges to the sheets 40*a* and 40*c*, and its layers are also secured together by means of a quilt-like pattern of stitches 70 (FIG. 7) that extend through the center portion of the three-layer composite 60, 62, 64 to restrict movement of the composite, especially after the absorption of perspiration or water which forms a gel when the absorbent layer 64 is super-absorbent cloth.

The three-layer laminate 60, 62, 64 has an important function in helping to prevent the absorbent layer 64, which becomes gel-like when wetted, from leaking through the seams and fabric layers 40*a* and 40*c*.

Many variations of the present invention within the scope of the appended claims will be apparent to those skilled in the art once the principles described herein are understood.

What is claimed is:

1. A removable anterior sweatband, comprising, a supporting member having a lower portion adapted to be placed between a headband and an outer portion of a hat or cap, and an upper portion, a pad connected to the upper portion of the supporting member and depending therefrom, said pad comprising a flexible laminate including an inner transfer layer adapted to contact a forehead of a person wearing a cap or hat, said transfer layer comprising moisture permeable cloth, an outer backing layer, and an enclosed moisture-absorbent sheet stock layer sandwiched between said inner and outer layers for holding moisture to provide evaporative cooling and for absorbing perspiration, the transfer layer and the backing layer being joined together at their edges to enclose the absorbent layer, such that the flexible laminate will conform to body contours of a user and absorb perspiration from a forehead of a user that would otherwise be transferred to a headband of a hat or cap to prevent a cap or hat from being soiled, thereby prolonging the life of a cap or hat.

2. The sweatband assembly of claim 1 wherein the backing layer is selected from the group consisting of layers that are semi-permeable and impermeable to water.

3. The sweatband assembly of claim 2 wherein the backing layer is plastic film.

4. The sweatband assembly of claim 1 wherein the absorbent layer is secured to adjacent sheet material by quilting selected from the group consisting of a plurality of rows of stitches and adhesively secured points to prevent the absorbent layer from moving freely within the laminate.

5. The sweatband assembly of claim 4 wherein the backing layer is selected from the group consisting of a layer of water impermeable and semi-permeable cloth.

6. The sweatband assembly of claim 4 wherein the backing layer comprises plastic film.

7. The sweatband assembly of claim 4 wherein the supporting member is a stiff sheet of stock material.

8. The sweatband assembly of claim 1 wherein the backing layer is cloth.

9. The sweatband assembly of claim 1 wherein the moisture-absorbent layer is a superabsorbent material.

10. The sweatband assembly of claim 1 wherein the moisture-absorbent sheet stock layer is a composite that has multiple layers.

11. The sweatband assembly of claim 1 wherein the moisture-absorbent sheet stock layer includes a hydrocolloid adapted to form a gel when saturated with moisture.

* * * * *